US010794627B2

(12) United States Patent
Olvera et al.

(10) Patent No.: US 10,794,627 B2
(45) Date of Patent: Oct. 6, 2020

(54) DOOR MOUNT AND ADJUST SYSTEM

(71) Applicant: Electrolux Home Products, Inc., Charlotte, NC (US)

(72) Inventors: Jose Carlos Trejo Olvera, Anderson, SC (US); Kelly Fox Hodnett, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 168 days.

(21) Appl. No.: 16/070,418

(22) PCT Filed: Jan. 18, 2017

(86) PCT No.: PCT/US2017/013923
§ 371 (c)(1),
(2) Date: Jul. 16, 2018

(87) PCT Pub. No.: WO2017/127418
PCT Pub. Date: Jul. 27, 2017

(65) Prior Publication Data

US 2019/0017739 A1 Jan. 17, 2019

Related U.S. Application Data

(60) Provisional application No. 62/279,864, filed on Jan. 18, 2016.

(51) Int. Cl.
*F25D 23/02* (2006.01)
*F25D 25/02* (2006.01)
(Continued)

(52) U.S. Cl.
CPC ..... *F25D 23/021* (2013.01); *E05D 13/00* (2013.01); *E05D 15/28* (2013.01); *F25D 25/025* (2013.01);
(Continued)

(58) Field of Classification Search
CPC ..... F25D 23/021; F25D 25/025; E05D 13/00; E05D 15/28; A47B 2210/175; A47B 88/956; E05Y 2600/12
See application file for complete search history.

(56) References Cited

U.S. PATENT DOCUMENTS 4,090,753 A * 5/1978 Rock ..... A47B 88/956 248/243
4,690,571 A 9/1987 Fulterer
(Continued)

FOREIGN PATENT DOCUMENTS

AT 361168 2/1981
AT 361168 T * 5/2007 ..... B23Q 39/04
DE 20101583 6/2002

OTHER PUBLICATIONS

International Search Report for PCT/US2017/013923, dated Apr. 25, 2017, 3 pages.

*Primary Examiner* — Hanh V Tran
(74) *Attorney, Agent, or Firm* — Pearne & Gordon LLP

(57) ABSTRACT

Closures for opening and closing the access openings of enclosures can include an adjusting feature that allows misalignments of the closures, in relation to seating surfaces at the access openings, to be corrected. A closure can include a closure inward surface that includes a closure inward surface seating site that is configured to engage an enclosure seating site at the access opening when the access opening is closed by the closure. At least one mounting bracket can be adjustably secured to the closure inward surface so as to be positionable at selected distances inwardly and outwardly of the closure inward surface. The at least one mounting bracket can be configured to have mounted thereto a system by means of which the closure can be supported for travel
(Continued)

along a path away from and toward the access opening upon the opening and closing, respectively, of the access opening by the closure.

19 Claims, 6 Drawing Sheets

(51) Int. Cl.
*E05D 15/28* (2006.01)
*A47B 88/956* (2017.01)
*E05D 13/00* (2006.01)

(52) U.S. Cl.
CPC ..... *A47B 88/956* (2017.01); *A47B 2210/175* (2013.01); *E05Y 2600/12* (2013.01); *E05Y 2900/31* (2013.01)

(56) References Cited

U.S. PATENT DOCUMENTS 6,390,576 B1 * 5/2002 Walburn ..... A47B 88/956 312/348.1
6,447,083 B1 9/2002 Chiapetta et al.
8,152,254 B2 * 4/2012 Kim ..... F25D 25/025 312/331
8,215,730 B2 7/2012 Brown et al.
8,360,539 B2 * 1/2013 Brown ..... F25D 25/025 312/402
8,382,219 B2 * 2/2013 Hottmann ..... A47B 96/00 312/405
9,074,404 B2 * 7/2015 DeLozier ..... E06B 5/00
9,433,292 B2 * 9/2016 Dubina ..... F25D 25/025
9,565,937 B1 * 2/2017 Jansen ..... A47B 88/45
9,661,924 B2 * 5/2017 Chen ..... A47B 88/956
9,752,817 B2 * 9/2017 Richards ..... F25D 23/028
2002/0153816 A1 * 10/2002 Banicevic ..... F25D 23/04 312/404
2004/0222725 A1 * 11/2004 Park ..... A47B 77/08 312/405
2005/0160854 A1 * 7/2005 Rotter ..... F25D 25/025 74/422
2007/0182293 A1 * 8/2007 Compagnucci ..... A47B 88/956 312/334.4
2008/0067303 A1 * 3/2008 Compagnucci ..... A47B 96/068 248/201
2008/0074019 A1 * 3/2008 Park ..... A47B 88/956 312/236
2009/0289537 A1 * 11/2009 Cabal Velarde ..... A47B 88/956 312/408
2010/0007249 A1 * 1/2010 Brown ..... F25D 23/021 312/109
2010/0033067 A1 * 2/2010 Kim ..... F25D 23/028 312/236
2013/0318874 A1 * 12/2013 DeLozier ..... E06B 5/00 49/260
2014/0239787 A1 * 8/2014 Mensa' ..... A47B 88/956 312/348.4
2015/0260443 A1 * 9/2015 Lee ..... F25D 23/02 312/404
2015/0282617 A1 * 10/2015 Chen ..... A47B 96/06 312/348.4

* cited by examiner

DOOR MOUNT AND ADJUST SYSTEM

CROSS-REFERENCE TO RELATED APPLICATIONS

This application is a U.S. national stage of PCT/US2017/013923 filed on Jan. 18, 2017, which claims benefit of U.S. Provisional Patent Application Ser. No. 62/279,864, filed Jan. 18, 2016, the disclosure of which is incorporated herein by reference.

BACKGROUND

1. Field of the Invention

The following description relates generally to mounting systems for closures and in particular mounting systems for doors that travel along a rectilinear path away from and toward access openings of enclosures in opening and closing, respectively, the access openings.

2. Related Art and Background

Closures, such as doors for example, that are provided to close access openings of enclosures can be misaligned with respect to the access openings so that the closures do not seat properly at the access openings. For example, it can be the case with the freezer compartment doors of bottom-mount refrigerators, which can travel along a rectilinear path away from and towards the access openings of freezer compartments in opening and closing the access openings, that the seating surfaces of the freezer compartment doors do not properly engage the seating surfaces at the access openings of the freezer compartments because of a misalignment of the seating surfaces of the freezer compartment doors with respect to the seating surfaces at the access openings of the freezer compartments. The misalignment can arise, for example, in the assembly of the refrigerators or subsequently as a result of use and/or the settling of various components of the refrigerators.

BRIEF SUMMARY OF THE INVENTION

The following presents a simplified summary of the invention in order to provide a basic understanding of some aspects of the invention. The summary does not represent an extensive overview of invention, nor is the summary intended to identify key or critical elements of the invention or delineate the scope of the invention. The sole purpose of the summary is to present certain concepts of the invention in a simplified form as a prelude to the description of the invention that is presented hereinafter.

According to one aspect of the invention, closures, such as doors for example, that are provided for opening and closing the access openings of enclosures can include an adjusting feature that allows misalignments of the doors, in relation to the seating surfaces that are provided at the access openings, to be corrected.

According to another aspect, an assembly can include a closure that is configured to open and close an access opening of an enclosure. The closure can include a closure inward surface that can be provided with a closure inward surface seating site that is configured to engage an enclosure seating site at the access opening when the access opening is closed by the closure. At least one mounting bracket can be adjustably secured to the closure at the closure inward surface so as to be positionable at selected distances inwardly and outwardly of the closure inward surface. The at least one mounting bracket can be configured to have mounted thereto a system by means of which the closure can be supported for travel along a path away from and toward the access opening upon the opening and closing, respectively, of the access opening by the closure.

According to a further aspect, the at least one mounting bracket can include a mounting bracket first portion and a mounting bracket second portion. At least one of the mounting bracket first portion and the mounting bracket second portion can be supported at the closure inward surface by a respective bracket adjusting arrangement that is located at the at least one of the mounting bracket first portion and the mounting bracket second portion. The respective bracket adjusting arrangement can be configured to position the at least one of the mounting bracket first portion and the mounting bracket second portion at which the respective bracket adjusting bracket arrangement is located a selected distance from the closure inward surface. As a result, the attitude of the closure inward surface seating site in relation to the enclosure seating site can be adjusted so as to correct a misalignment of the closure inward surface seating site in relation to the enclosure seating site.

According to an additional aspect, the respective bracket adjusting arrangement can include a bracket first opening in the at least one of the mounting bracket first portion and the mounting bracket second portion at which the respective bracket adjusting arrangement is located. The respective bracket adjusting arrangement also can include an adjusting element that extends through the bracket first opening, the adjusting element including an adjusting element first portion and an adjusting element second portion. The adjusting element first portion can be threaded so as to adjustably secure the adjusting element to the closure inwardly and outwardly of the closure inward surface. The adjusting element second portion can include an attaching feature at which the at least one of the mounting bracket first portion and mounting bracket second portion at which the respective bracket adjusting arrangement is located is attached to the adjusting element. Thereby, adjustment of the adjusting element inwardly and outwardly of the closure inward surface can adjust the distance at which the at least one of the mounting bracket first portion and the mounting bracket second portion at which the respective bracket adjusting arrangement is located is spaced from the closure inward surface.

According to yet another aspect, the attaching feature can comprise a groove into which the at least one of the mounting bracket first portion and the mounting bracket second portion at which the respective bracket adjusting arrangement is located extends.

According to yet a further aspect, the bracket first opening can comprise a slot that extends through an edge of the at least one of the mounting bracket first portion and mounting bracket second portion at which the respective bracket adjusting arrangement is located and into which the adjusting element second portion is slidably received. Also, the respective bracket adjusting arrangement can include at least one bracket second opening in the at least one of the mounting bracket first portion and the mounting bracket second portion at which the respective bracket adjusting arrangement is located through which a bracket supporting element extends. The bracket supporting element can include a bracket supporting element first portion that is secured to the closure at the closure inward surface and a bracket supporting element second portion. The bracket supporting element second portion can be slidably received within the at least one bracket second opening and present a surface along which the at least one of the mounting bracket first portion and mounting bracket second portion at which the respective bracket adjusting arrangement is located slides pursuant to the adjustment of the adjusting element inwardly and outwardly of the closure inward surface.

According to yet an additional aspect, the closure can include a closure first boundary that is situated transversely of the path of travel of the closure and a closure second boundary that is situated transversely of the path of travel of the closure. The at least one mounting bracket can comprise a first mounting bracket that is mounted between the closure first boundary and the closure second boundary and a second mounting bracket that is mounted between the closure first boundary and the closure second boundary.

According to still another aspect, the first mounting bracket can include a first mounting bracket first portion and a first mounting bracket second portion and the second mounting bracket can include a second mounting bracket first portion and a second mounting bracket second portion. Each of the first mounting bracket first portion, the first mounting bracket second portion, the second mounting bracket first portion and the second mounting bracket second portion can be supported at the closure inward surface by a respective bracket adjusting arrangement that is configured to position a respective one of the first mounting bracket first portion, the first mounting bracket second portion, the second mounting bracket first portion and the second mounting bracket second portion a selected distance from the closure inward surface.

According to still a further aspect, each bracket adjusting arrangement can include a respective bracket first opening in the first mounting bracket first portion, the first mounting bracket second portion, the second mounting bracket first portion and the second mounting bracket second portion and a respective adjusting element that extends through the respective bracket first opening in each of the first mounting bracket first portion, the first mounting bracket second portion, the second mounting bracket first portion and the second mounting bracket second portion. Each adjusting element can include an adjusting element first portion and an adjusting element second portion with each adjusting element first portion being threaded so as to adjustably secure the adjusting element to the closure inwardly and outwardly of the closure inward surface and each adjusting element second portion including an attaching feature at which a respective one of the first mounting bracket first portion, the first mounting bracket second portion, the second mounting bracket first portion and the second mounting second portion is attached. As a result, adjustment of each respective adjusting element inwardly and outwardly of the closure inward surface can adjust the distance at which the first mounting bracket first portion, the first mounting bracket second portion, the second mounting bracket first portion and the second mounting bracket second portion is spaced from the closure inward surface such that the attitude of the closure inward surface seating site in relation to the enclosure seating site is adjusted so as to correct a misalignment of the closure inward surface seating site in relation to the enclosure seating site.

According to still a further aspect, each attaching feature can comprise a groove into which a respective one of the first mounting bracket first portion, the first mounting bracket second portion, the second mounting bracket first portion and the second mounting bracket second portion extends.

According to still an additional aspect, each bracket first opening can comprise a slot that extends through an edge of a respective first mounting bracket first portion, a first mounting bracket second portion, a second mounting bracket first portion and a second mounting bracket second portion and into which a respective adjusting element second portion is slidably received. Each bracket adjusting arrangement can include a respective at least one bracket second opening in the respective first mounting bracket first portion, the first mounting bracket second portion, the second mounting bracket first portion and the second mounting bracket second portion through which a respective bracket supporting element extends. Each bracket supporting element can include a bracket supporting element first portion that is secured to the closure at the closure inward surface and a bracket supporting element second portion that is slidably received within a respective one of the at least one bracket second opening and along which a respective one of the first mounting bracket first portion, the first mounting bracket second portion, the second mounting bracket first portion and the second mounting bracket second portion slides pursuant to the adjustment of a respective adjusting element inwardly and outwardly of the closure inward surface.

According to another aspect, the closure in all the foregoing aspects can comprise the door of a refrigeration appliance, and in a particular embodiment, the door of the refrigeration appliance can comprise the door of a freezer compartment of a bottom-mount refrigerator.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DETAILED DESCRIPTION

Figure 1:
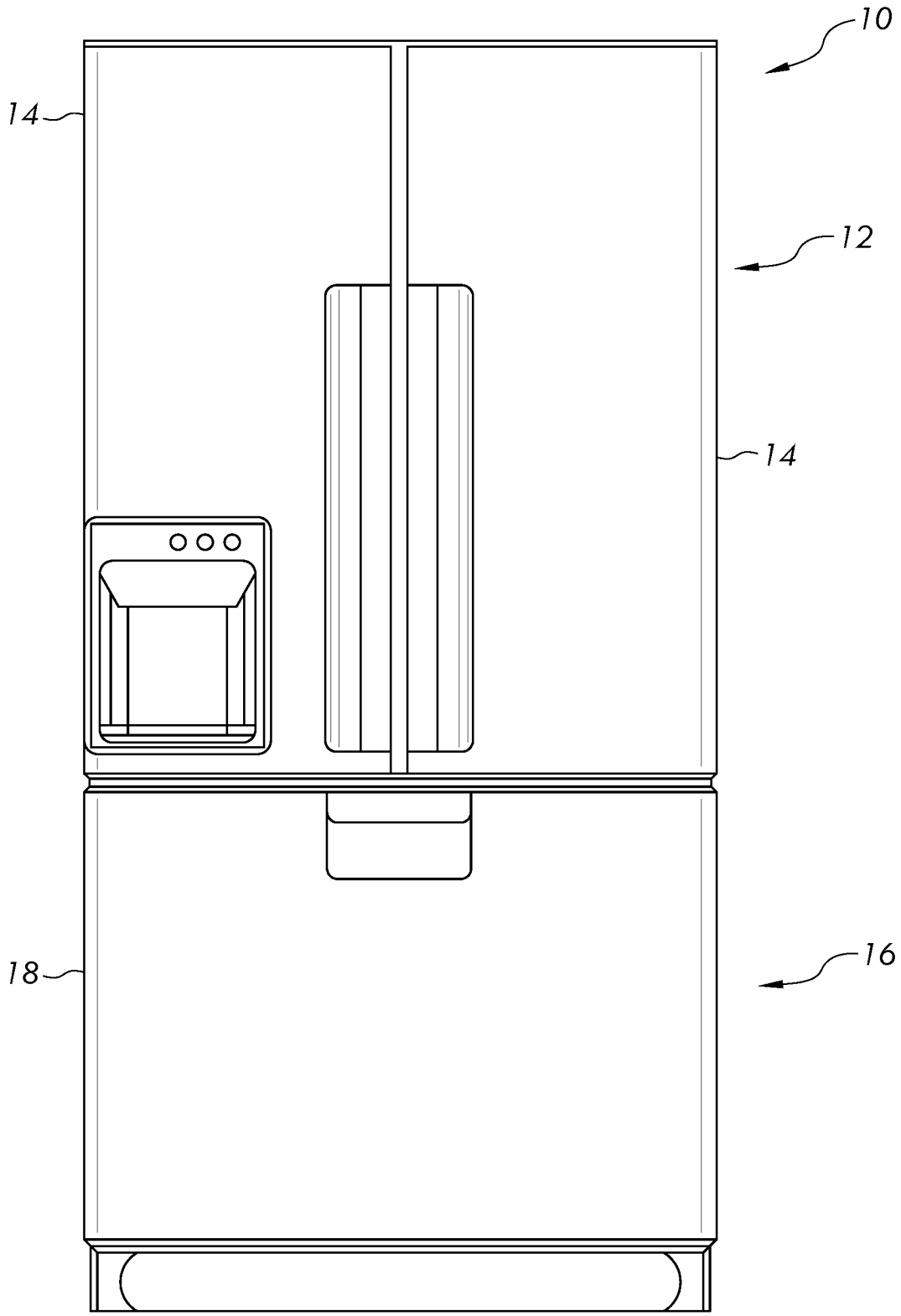
FIG. 1 is a front elevational view of an example of a bottom-mount refrigerator at which an example of the present invention can be applied at the freezer compartment door of the refrigerator.

In the following description of the present invention reference is made to the accompanying drawings which form a part thereof, and in which is shown, by way of illustration, exemplary embodiments illustrating the principles of the present invention and how it may be practiced. It is to be understood that other embodiments may be utilized to practice the present invention and structural and functional changes may be made thereto without departing from the scope of the present invention.

Embodiments of the present invention relate to an adjustable system for mounting to a door. The present invention will now be described with reference to the drawings, wherein like reference numerals are used to refer to like elements throughout. It is to be appreciated that the various drawings are not necessarily drawn to scale from one figure to another or within a given figure. Also, the sizes of the components are somewhat arbitrarily drawn in order to facilitate an understanding of the drawings. In the following description, numerous specific details are set forth in order to provide a thorough understanding of the present invention, but it can be possible in certain instances to practice the present invention without those specific details. Additionally, the examples discussed are not intended to be a limit on the invention. For example, one or more aspects of the disclosed examples can be utilized in other examples and even other types of apparatus and devices.

In reference to the disclosure herein, for purposes of convenience and clarity only, directional terms, such as, top, bottom, left, right, up, down, upper, lower, over, above, below, beneath, rear, and front, may be used. Such directional terms should not be construed to limit the scope of the invention in any manner. It is to be understood that embodiments presented herein are by way of example and not by way of limitation. The intent of the following detailed description, although discussing exemplary embodiments, is to be construed to cover all modifications, alternatives, and equivalents of the embodiments as may fall within the spirit and scope of the invention.

When closing a compartment door in a refrigerator it is important to achieve and maintain a proper seal between the door and the refrigerator. In order to maintain a desired temperature in the refrigerator efficiently, the seal between the door and the refrigerator should surround the space between the door and the refrigerator. In a bottom mount refrigerator where a freezer compartment is located on the bottom and a fresh-food compartment is located on the top, a system is commonly attached to the freezer compartment door to allow travel toward and away from the freezer compartment along a rectilinear part defined in the freezer compartment. The disclosed device can be attached on the inside of the compartment door between the compartment door and the system to adjust the placement of the door with respect to the system. The device is attached an anchor nut on the inside of the compartment door. The device can be adjusted in two directions with respect to the anchor nut by an adjusting element.

Figure 2:
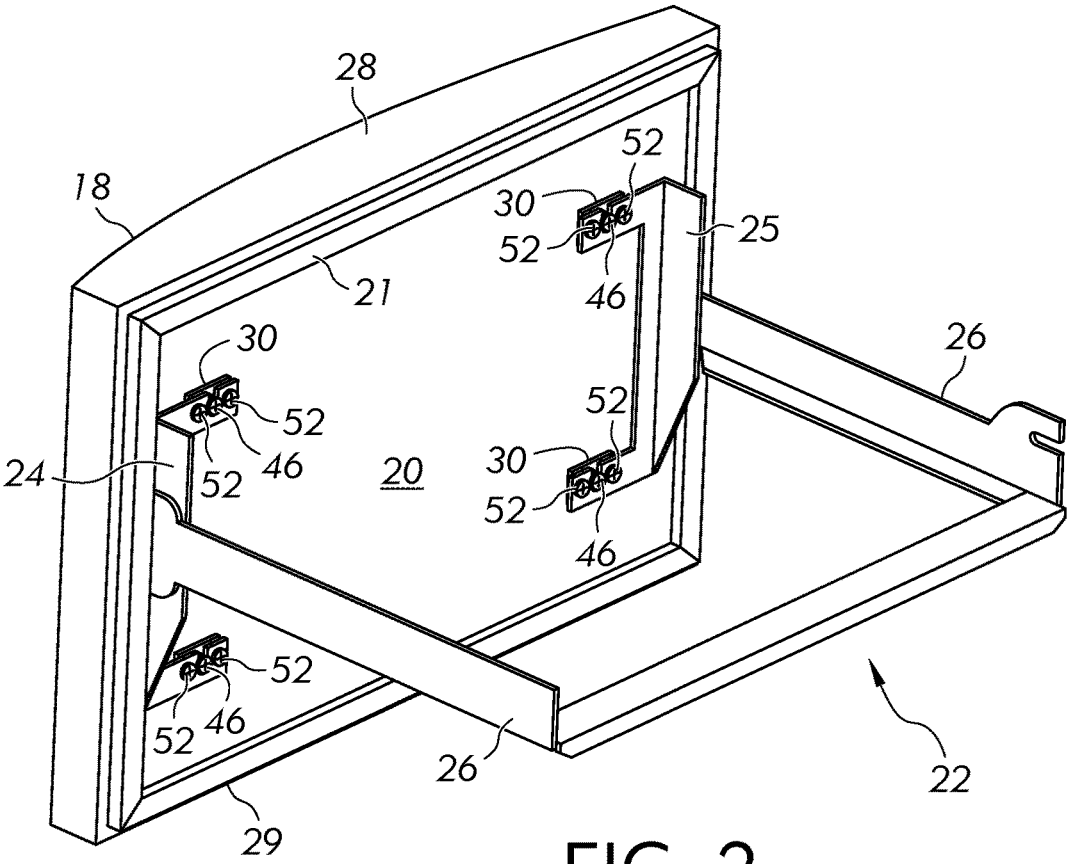
FIG. 2 is a perspective view of an assembly including a freezer compartment door at which mounting brackets in accordance with an example of the invention are installed, the mounting brackets having mounted thereto a system by means of which the freezer compartment door travels along a rectilinear path away from and towards an access opening of a freezer compartment in opening and closing, respectively, the access opening.
Figure 3:
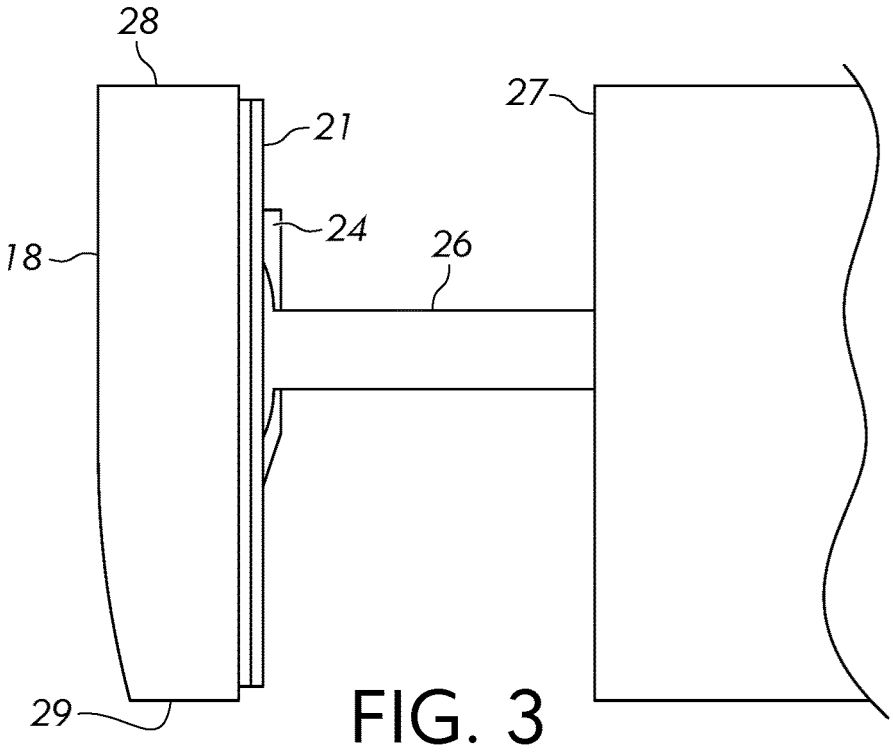
FIG. 3 is a side elevational view of a freezer compartment door, such as the freezer compartment door of FIG. 2, that is pulled away from a corresponding freezer compartment.

Referring first to FIG. 1, there is illustrated an example embodiment of a refrigeration appliance comprising a bottom-mount refrigerator, indicated generally at 10. The bottom-mount refrigerator 10 includes a fresh food compartment, indicated generally at 12, and a freezer compartment, indicated generally at 16, and comprising an example of an enclosure. The fresh food compartment 12 includes fresh food compartment double doors 14-14 that provide access to the interior of the fresh food compartment 12 and the freezer compartment 16 includes a freezer compartment door 18, comprising a closure that is configured to open and close an access opening of the freezer compartment 16. As shown in FIG. 2 and FIG. 3, the freezer compartment door 18 includes a freezer door inside surface, indicated generally at 20, comprising a closure inward surface. The freezer door inside surface 20 includes a closure inward surface seating site that is configured to engage a freezer compartment seating site at the access opening when the access opening is closed by the freezer compartment door 18. Specifically, the freezer door inside surface 20 includes a seal 21 that is located at the perimeter of the freezer door inside surface 20. The seal 21 comprises the closure inward surface seating site and seats against the cabinet of the freezer compartment at the freezer compartment access opening. In one embodiment, the seal 21 is in the form of a rubber gasket.

The freezer compartment door 18 is part of an assembly that includes at least one mounting bracket that is adjustably secured to the freezer compartment door 18 at the freezer door inside surface 20 so as to be positioned at selected distances inwardly and outwardly of the freezer door inside surface 20 as described in greater detail below. In the example of the drawings, a first mounting bracket 24 and a second mounting bracket 25 are provided at opposite sides of the freezer door inside surface 20. The first mounting bracket 24 and the second mounting bracket 25 are configured to have mounted thereto a system, indicated generally at 22, by means of which the freezer compartment door 18 is supported for travel along a path away from and toward the access opening of the freezer compartment upon the opening and closing, respectively, of the access opening by the freezer compartment door 18. In the embodiment shown in the drawings, the system 22 comprises a respective rail 26 mounted to the first mounting bracket 24 and the second mounting bracket 25, the rails being slidably received at tracks (not shown) installed at opposite sides of the interior of the freezer compartment 16, whereby the freezer compartment door 18 travels along a rectilinear path toward and away from the freezer compartment access opening.

The freezer compartment door 18 includes a freezer compartment door upper portion 28 that comprises a closure first boundary that is situated transversely of the rectilinear path of travel of the freezer compartment door 18 and a freezer compartment door lower portion 29 that comprises a closure second boundary that also is situated transversely of the rectilinear path of travel of the freezer compartment door 18. Each of the first mounting bracket 24 and the second mounting bracket 25 is mounted between the freezer compartment door upper portion 28 and the freezer compartment door lower portion 29.

Figure 4:
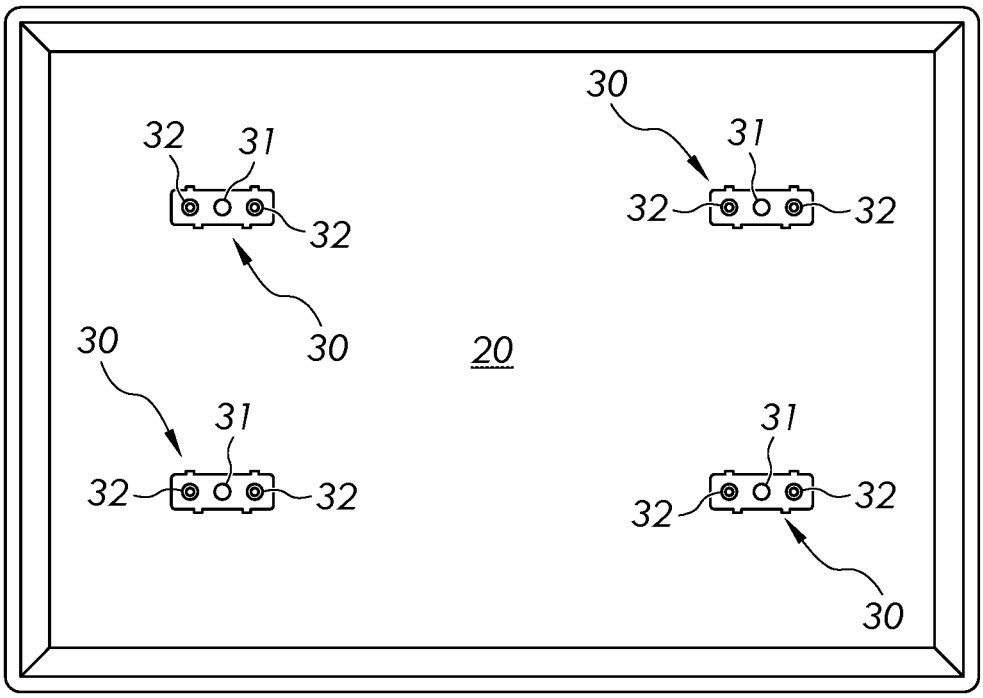
FIG. 4 is an elevational view of an inward surface of a freezer compartment door such as the freezer compartment door of FIGS. 2 and 3 at which mounting brackets for adjusting the positioning of the freezer compartment door can be installed in accordance with an example the invention.
Figure 5:
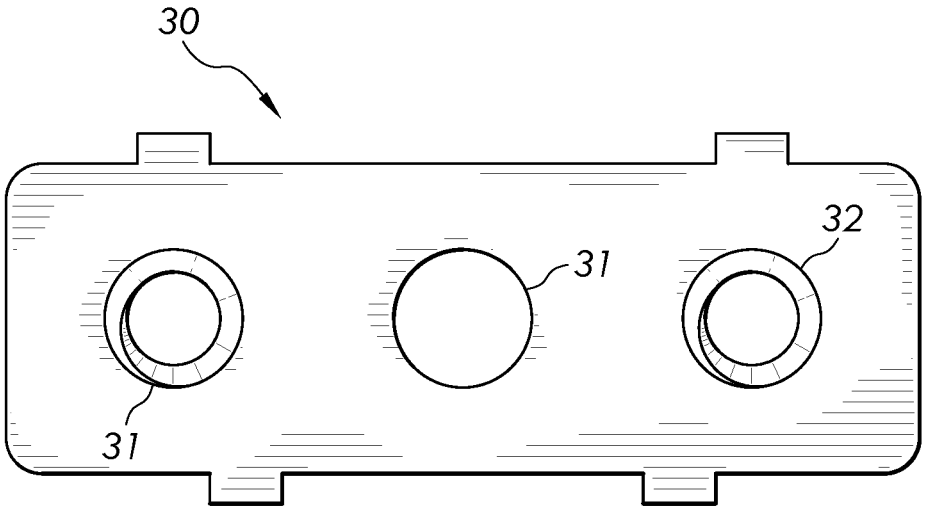
FIG. 5 is front view of an example of an anchor nut that can be provided at the inward surface of the freezer compartment door of FIGS. 2, 3, and 4 and at which a mounting bracket can be installed in accordance with an example of the invention.

Referring now to FIG. 4 and FIG. 5, the freezer door inside surface 20 is shown to include anchor nuts, indicated generally at 30, by means of which the first mounting bracket 24 and the second mounting bracket 25 are secured to the freezer compartment door 18 at the freezer door inside surface 20. At least one anchor nut includes a protrusion that has a corresponding hole in the inner plastic liner for insertion of the anchor nut into the plastic liner to help keep the anchor nut in place during the foaming process. In one embodiment, the anchor nuts 30 include tabs that are passed through corresponding tab holes formed in punch-outs of the inner plastic liner of the freezer compartment door 18 at the freezer door inside surface 20. After the tabs are inserted through the tab holes, each of the anchor nuts 30 is slid horizontally. A stop is provided on each of the anchor nuts to ensure proper alignment of the anchor nut with the punch-out. The anchor nuts are secured within the freezer compartment door 18 by foam insulation. Each anchor nut includes an adjustment hole 31 to accept an adjusting element and at least one locking hole 32 to accept a bracket supporting element as described in greater detail below. In one embodiment shown in the drawings, the anchor nut includes two locking holes 32, each on opposite sides of the adjustment hole 31. In another embodiment, the bracket supporting element comprises a locking shoulder screw.

Figure 6:
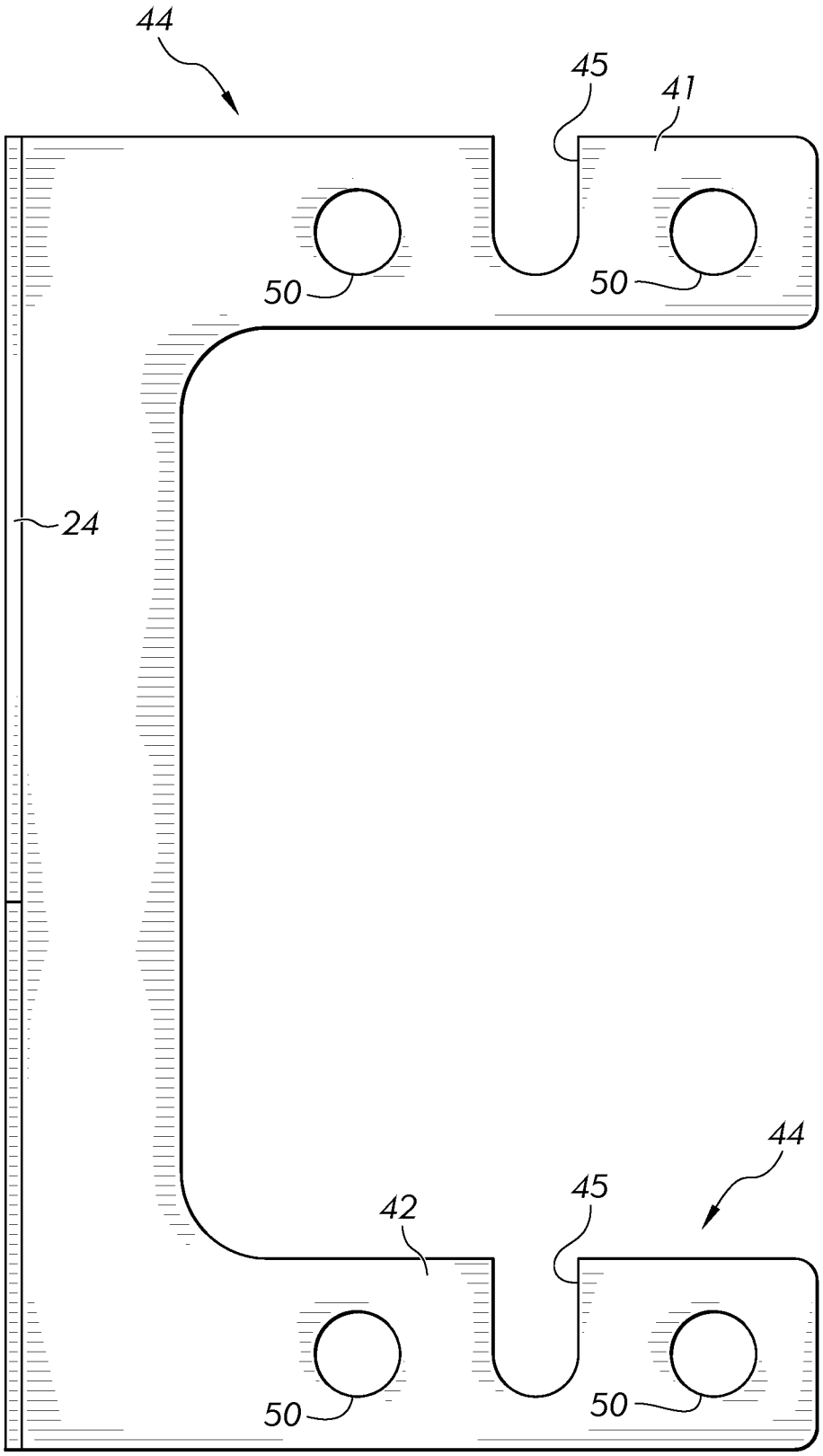
FIG. 6 is a front view of an example of a mounting bracket that can be installed at the inward surface of the freezer compartment door of FIGS. 2, 3, 4, and 5 in accordance with an example of the invention.

Each mounting bracket comprises at least a mounting bracket first portion supported at the freezer door inside surface by a respective bracket adjusting arrangement. Referring to FIG. 6, the first mounting bracket 24 in the example of the figures is shown to include a mounting bracket first portion 41 and a mounting bracket second portion 42. The second mounting bracket 25 in the example embodiment illustrated in the drawings comprises a mirror image of the first mounting bracket 24 so that the description herein of the first mounting bracket 24 is also applicable to the second mounting bracket but with the respective left and right sides of the two brackets reversed.

In the example of the invention shown in the drawings, each of the mounting bracket first portion 41 and the mounting bracket second portion 42 is supported at the freezer door inside surface 20 by a respective bracket adjusting arrangement, indicated generally at 44, that is configured to position each of the mounting bracket first portion 41 and the mounting bracket second portion 42 a selected distance from the freezer door inside surface 20. By means of this adjusting arrangement, the attitude of the freezer door inside surface seating site comprising the seal 21 in relation to the freezer compartment 16 seating site can be adjusted so as to correct any misalignment of the freezer door inside surface seating site comprising the seal 21 in relation to the freezer compartment seating site. It is not required that two mounting brackets be provided or that adjusting arrangements be provided at both of a bracket first portion and a bracket second portion. It is only necessary that at least one of the mounting bracket first portion 41 and the mounting bracket second portion 42 is supported at the closure inward surface by a respective bracket adjusting arrangement 44 that is configured to position the at least one of the mounting bracket first portion 41 and the mounting bracket second portion 42 at which the respective bracket adjusting arrangement 44 is located a selected distance from the freezer door inside surface 20, whereby the attitude of the closure inward surface seating site, comprising the seal 21, in relation to the enclosure seating site 27 is adjusted so as to correct a misalignment of the closure inward surface seating site in relation to the enclosure seating site 27.

The bracket adjusting arrangement 44 can be provided at any one or more of the mounting bracket first portion 41 of the first mounting bracket 24 and the second mounting bracket 25 and the mounting bracket second portion 42 of the first mounting bracket 24 and the second mounting bracket 25. In the example shown in the drawings, a bracket adjusting arrangement 44 is located at each of the mounting bracket first portion 41 of the first mounting bracket 24 and the second mounting bracket 25 and the mounting bracket second portion 42 of the first mounting bracket 24 and the second mounting bracket 25.

Figure 7:
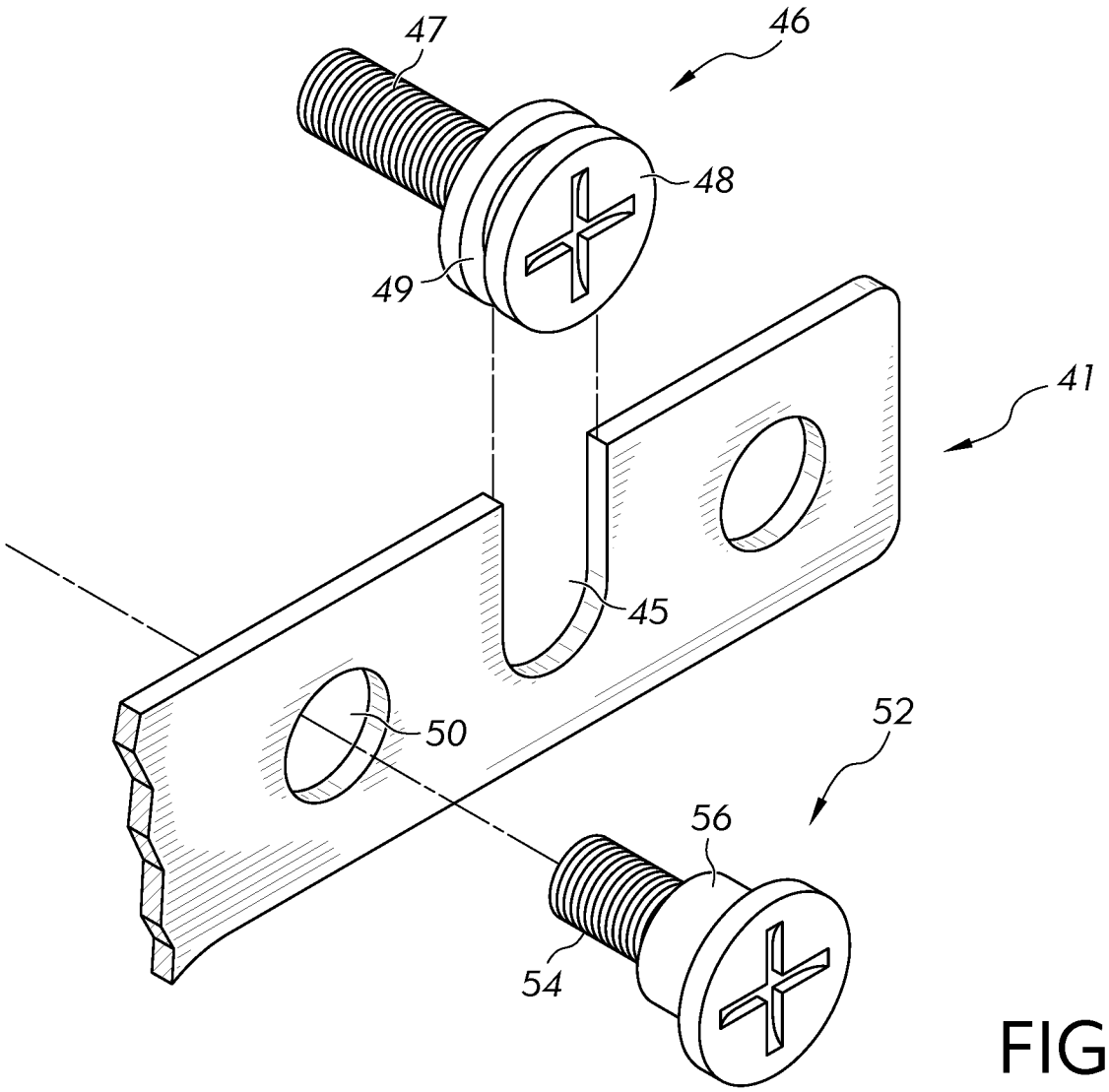
FIG. 7 is a perspective and somewhat schematic view of an example of certain components of the present invention employed at the mounting bracket of FIG. 6 for mounting and adjusting the positioning of the freezer compartment door at which the bracket is installed.

As best seen in FIG. 7, the bracket adjusting arrangement 44 includes a bracket first opening 45 in the mounting bracket first portion 41 of the first mounting bracket 24. An adjusting element, indicated generally at 46, extends through the bracket first opening 45. One embodiment of the adjusting element shown in FIG. 7 comprises a washer shoulder screw. The adjusting element 46 includes an adjusting element first portion 47 and an adjusting element second portion 48. The adjusting element first portion 47 can be adjustably secured to the freezer door inside surface 20. In one embodiment, the adjusting element first portion 47 is threaded so as to adjustably secure the adjusting element 46 to the freezer compartment door 18 inwardly and outwardly of the freezer door inside surface 20. The adjusting element second portion 48 includes an attaching feature 49 at which the mounting bracket first portion 41 of the first mounting bracket 24 is attached to the adjusting element 46. In the example of the drawings, the attaching feature 49 comprises a groove into which the mounting bracket first portion 41 of the first mounting bracket 24 extends. With the described construct, adjustment of the adjusting element 46 inwardly and outwardly of the freezer door inside surface 20 adjusts the distance at which the mounting bracket first portion 41 of the first mounting bracket 24 is spaced from the freezer door inside surface 20.

The bracket first opening 45 can comprise a slot that extends through an edge of the mounting bracket first portion 41 of the first mounting bracket 24 and into which the adjusting element second portion 48 is slidably received. The steps of installing one embodiment of the mounting bracket will now be described. When installing the first mounting bracket 24, the adjusting element 46 is threaded into the freezer compartment door 18 at an adjustment hole 31 and the mounting bracket is then placed below the adjusting element 46 so that the bracket first opening 45 is in line with the adjusting element 46. The first mounting bracket is then raised so as to slide the mounting bracket first portion 41 of the first mounting bracket 24 within the attaching feature 49 of the adjusting element 46. A similar circumstance prevails at the mounting bracket second portion 42 of the first mounting bracket 24

Figure 9:
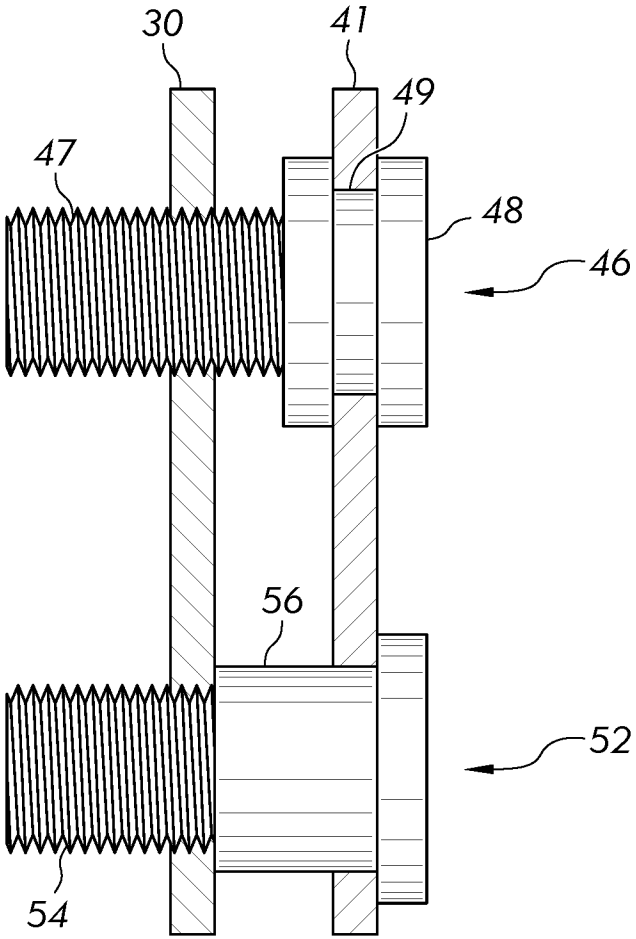
FIG. 9 is a somewhat schematic cross-sectional view of the components of FIG. 8 following their adjustment at the freezer compartment door in accordance with an example of the invention.
Figure 8:
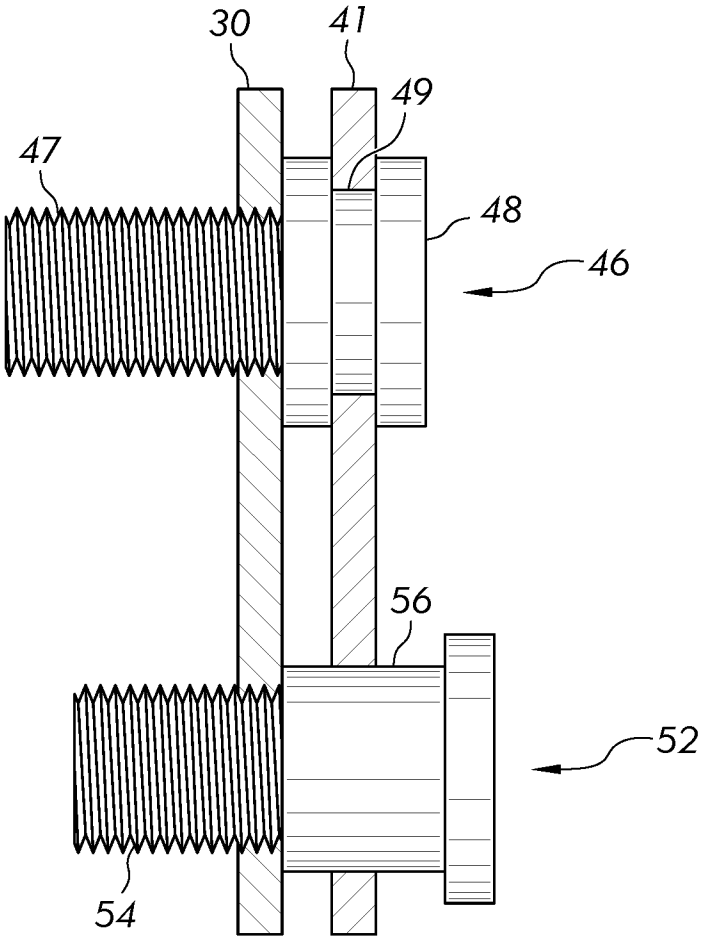
FIG. 8 is a somewhat schematic cross-sectional view of the components of FIG. 7 prior to being adjusted at the freezer compartment door.

Once the first mounting bracket 24 is in place at the adjusting element 46, the mounting bracket is secured to the anchor nut 30 at one or both locking holes 32. In this regard, the bracket adjusting arrangement 44 includes at least one bracket second opening 50 in the mounting bracket first portion 41 of the first mounting bracket 24 through which a bracket supporting element 52 extends. The bracket supporting element 52 includes a bracket supporting element first portion 54 that is secured to the freezer compartment door 18 at the freezer door inside surface 20 and a bracket supporting element second portion 56 that is slidably received within the bracket second opening 50. It is along the bracket supporting element second portion 56 that the mounting bracket first portion 41 of the first mounting bracket 24 slides pursuant to the adjustment of the adjusting element 46 inwardly and outwardly of the freezer door inside surface 20. FIG. 8 is a cross-sectional view of FIG. 7 that illustrates the spatial relationships that prevail among the adjusting element 46, the bracket supporting element 52, the anchor nut 30 and the mounting bracket first portion 41 of the first mounting bracket 24 before any adjustment of the adjusting element has been made; and FIG. 9 is a cross-sectional view of FIG. 7 that illustrates the spatial relationships that prevail among the adjusting element 46, the bracket supporting element 52, the anchor nut 30 and the mounting bracket first portion 41 of the first mounting bracket 24 following an adjustment of the adjusting element.

The invention has been described herein above using specific examples; however, it will be understood by those skilled in the art that various alternatives may be used and equivalents may be substituted for elements or steps described herein without deviating from the scope of the invention. Modifications may be necessary to adapt the invention to a particular situation or to a particular need without departing from the scope of the invention. It is intended that the invention not be limited to the particular implementation described herein, but that the claims be given their broadest interpretation to cover all embodiments, literal or equivalent, covered thereby.

What is claimed is:

1. An assembly including:

a closure configured to open and close an access opening of an enclosure, the closure including a closure inward surface provided with a closure inward surface seating site that is configured to engage an enclosure seating site at the access opening when the access opening is closed by the closure; and at least one mounting bracket adjustably secured to the closure at the closure inward surface so as to be positionable at selected distances inwardly and outwardly of the closure inward surface, the at least one mounting bracket configured to have mounted thereto a system by which the closure is supported for travel along a path away from and toward the access opening upon the opening and closing, respectively, of the access opening by the closure, wherein the at least one mounting bracket includes a mounting bracket first portion and a mounting bracket second portion that are both supported at the closure inward surface by a respective bracket adjusting arrangement that is configured to independently position each of the mounting bracket first portion and the mounting bracket second portion a selected distance from the closure inward surface, whereby an attitude of the closure inward surface seating site in relation to the enclosure seating site is adjusted by independently positioning each of the mounting bracket first portion and the mounting bracket second portion at selected distances from the closure inward surface, so as to correct a misalignment of the closure inward surface seating site in relation to the enclosure seating site.

2. The assembly of claim 1, wherein the closure comprises the door of a refrigeration appliance.

3. The assembly of claim 2, wherein the door of the refrigeration appliance comprises the door of a freezer compartment of a bottom-mount refrigerator.

4. The assembly of claim 1 wherein the respective bracket adjusting arrangement includes:

a bracket first opening in each of the mounting bracket first portion and the mounting bracket second portion; and an adjusting element that extends through each bracket first opening provided in each of the mounting bracket first portion and the mounting bracket second portion, the adjusting element including an adjusting element first portion and an adjusting element second portion, the adjusting element first portion being threaded so as to adjustably secure the adjusting element to the closure inwardly and outwardly of the closure inward surface, and the adjusting element second portion including an attaching feature at which the mounting bracket first portion and mounting bracket second portion is attached to the respective adjusting element, whereby adjustment of the adjusting element inwardly and outwardly of the closure inward surface adjusts the respective distance at which the mounting bracket first portion and the mounting bracket second portion is spaced from the closure inward surface.

5. The assembly of claim 4, wherein the attaching feature comprises a groove into which the respective mounting bracket first portion and the mounting bracket second portion extends.

6. The assembly of claim 5, wherein the bracket first opening comprises a slot that extends through an edge of the respective mounting bracket first portion and mounting bracket second portion and into which the adjusting element second portion is slidably received, and the respective bracket adjusting arrangement includes at least one bracket second opening in the each mounting bracket first portion and the mounting bracket second portion through which a bracket supporting element extends, the bracket supporting element including a bracket supporting element first portion that is secured to the closure at the closure inward surface and a bracket supporting element second portion that is slidably received within the at least one bracket second opening and along which the at least one of the mounting bracket first portion and mounting bracket second portion at which the respective bracket adjusting arrangement is located slides pursuant to the adjustment of the adjusting element inwardly and outwardly of the closure inward surface.

7. The assembly of claim 1, wherein the closure includes a closure first boundary situated transversely of the path of travel of the closure and a closure second boundary situated transversely of the path of travel of the closure, and the at least one mounting bracket comprises a first mounting bracket mounted between the closure first boundary and the closure second boundary and a second mounting bracket mounted between the closure first boundary and the closure second boundary.

8. The assembly of claim 7, wherein the closure comprises the door of a refrigeration appliance.

9. The assembly of claim 8, wherein the door of the refrigeration appliance comprises the door of a freezer compartment of a bottom-mount refrigerator.

10. The assembly of claim 7, wherein the second mounting bracket includes a second mounting bracket first portion and a second mounting bracket second portion, and each of the first mounting bracket first portion, the first mounting bracket second portion, the second mounting bracket first portion and the second mounting bracket second portion is supported at the closure inward surface by a respective bracket adjusting arrangement that is configured to position a respective one of the first mounting bracket first portion, the first mounting bracket second portion, the second mounting bracket first portion and the second mounting bracket second portion a selected distance from the closure inward surface.

11. The assembly of claim 10, wherein each bracket adjusting arrangement includes a respective bracket first opening in the first mounting bracket first portion, the first mounting bracket second portion, the second mounting bracket first portion and the second mounting bracket second portion and a respective adjusting element that extends through the respective bracket first opening in each of the first mounting bracket first portion, the first mounting bracket second portion, the second mounting bracket first portion and the second mounting bracket second portion, each adjusting element including an adjusting element first portion and an adjusting element second portion, each adjusting element first portion being threaded so as to adjustably secure the adjusting element to the closure inwardly and outwardly of the closure inward surface, and each adjusting element second portion including an attaching feature at which a respective one of the first mounting bracket first portion, the first mounting bracket second portion, the second mounting bracket first portion and the second mounting second portion is attached, whereby adjustment of each respective adjusting element inwardly and outwardly of the closure inward surface adjusts the distance at which the first mounting bracket first portion, the first mounting bracket second portion, the second mounting bracket first portion and the second mounting bracket second portion is spaced from the closure inward surface such that the attitude of the closure inward surface seating site in relation to the enclosure seating site is adjusted so as to correct a misalignment of the closure inward surface seating site in relation to the enclosure seating site.

12. The assembly of claim 9, wherein each attaching feature comprises a groove into which a respective one of the first mounting bracket first portion, the first mounting bracket second portion, the second mounting bracket first portion and the second mounting bracket second portion extends.

13. The assembly of claim 10, wherein each bracket first opening comprises a slot that extends through an edge of a respective first mounting bracket first portion, a first mounting bracket second portion, a second mounting bracket first portion and a second mounting bracket second portion and into which a respective adjusting element second portion is slidably received, and each bracket adjusting arrangement includes a respective at least one bracket second opening in the respective first mounting bracket first portion, the first mounting bracket second portion, the second mounting bracket first portion and the second mounting bracket second portion through which a respective bracket supporting element extends, each bracket supporting element including a bracket supporting element first portion that is secured to the closure at the closure inward surface and a bracket supporting element second portion that is slidably received within a respective one of the at least one bracket second opening and along which a respective one of the first mounting bracket first portion, the first mounting bracket second portion, the second mounting bracket first portion and the second mounting bracket second portion slides pursuant to the adjustment of a respective adjusting element inwardly and outwardly of the closure inward surface.

14. The assembly of claim 13, wherein the closure comprises the door of a refrigeration appliance.

15. The assembly of claim 14, wherein the door of the refrigeration appliance comprises the door of a freezer compartment of a bottom-mount refrigerator.

16. An assembly including:

at least one mounting bracket with a mounting bracket first portion and a mounting bracket second portion;

at least one bracket opening in each of the mounting bracket first portion and the mounting bracket second portion;

at least two anchor nuts with at least one adjustment hole attached to an inside surface of a refrigerator door; and an adjusting element extending through each of the at least one opening provided in the mounting bracket first portion and the mounting bracket second portion, and the at least one adjustment element including an adjusting element first portion and an adjusting element second portion, wherein the adjusting element first portion is threaded and wherein the adjusting element second portion includes an attaching feature, wherein the adjusting element first portion further extends into the surface, and wherein each of the mounting bracket first portion and the mounting bracket second portion are independently positioned a selected distance from the inside surface of the refrigerator door by each respective adjusting element.

17. The assembly of claim 16, wherein the attaching feature comprises a groove.

18. A method of mounting an assembly to a door, the method comprising the steps of:

providing at least two anchor nuts, each anchor nut provided with at least one adjustment hole and at least one locking hole;

providing at least one mounting bracket having a mounting bracket first portion and a mounting bracket second portion, wherein each of the mounting bracket first portion and the mounting bracket second portion includes a bracket first opening and at least one bracket second opening;

attaching the at least two anchor nuts to a surface of the door;

inserting an adjusting element into each adjustment hole, wherein the adjusting element comprises an adjusting element first portion and an adjusting element second portion with an attaching feature and wherein the adjusting element first portion is inserted through the adjustment hole into the door;

adjusting the distance of each attaching feature from the surface of the door to a desired distance;

attaching the at least one mounting bracket to the door by attaching each bracket first opening provided on the mounting bracket first portion and the mounting bracket second portion to the respective attaching feature; and independently positioning each of the mounting bracket first portion and the mounting bracket second portion a selected distance from the surface of the door by each respective adjusting element.

19. The method of claim 18, further comprising securing the at least one mounting bracket to the at least two anchor nuts by inserting a bracket supporting element through each of the at least one bracket second opening, provided on the mounting bracket first portion and the mounting bracket second portion, to the at least one locking hole, provided on the at least two anchor nuts, and further into the door.

* * * * *